United States Patent [19]

Yamazaki et al.

[11] Patent Number: 4,469,434

[45] Date of Patent: Sep. 4, 1984

[54] CLEANING APPARATUS FOR ELECTROPHOTOGRAPHY

[75] Inventors: Yoshio Yamazaki; Kouichi Gunzi; Shigeru Inowa, all of Hachioji, Japan

[73] Assignee: Konishiroku Photo Industry Co., Ltd., Tokyo, Japan

[21] Appl. No.: 336,869

[22] Filed: Jan. 4, 1982

[30] Foreign Application Priority Data

Jan. 27, 1981 [JP] Japan ..... 56-11332

[51] Int. Cl.[3] ..... G03G 21/00

[52] U.S. Cl. ..... 355/15; 15/256.51

[58] Field of Search ..... 355/3 R, 15; 15/1.5 R, 15/256.51, 256.52

[56] References Cited

U.S. PATENT DOCUMENTS

| | | | |
|---|---|---|---|
| 3,552,850 | 1/1971 | Royka et al. | 355/15 |
| 3,577,649 | 5/1971 | Wadsworth et al. | 15/256.51 X |
| 3,660,863 | 5/1972 | Gerbasi | 15/1.5 R X |
| 3,859,691 | 1/1975 | Katayama et al. | 15/256.51 |
| 4,026,648 | 5/1977 | Takahashi | 355/15 |
| 4,247,196 | 1/1981 | Ogawa et al. | 355/15 |
| 4,334,766 | 6/1982 | Sugiyama et al. | 355/15 |

*Primary Examiner*—Fred L. Braun

*Attorney, Agent, or Firm*—Frishauf, Holtz, Goodman & Woodward

[57] ABSTRACT

A cleaning apparatus for a toner image retaining member of an electrophotographic copying machine includes an elastic cleaning blade for removing residual toner from the surface of the toner image retaining member, the elastic cleaning blade having two opposite ends, one end having a protuberance with a cleaning edge. A holder is arranged along a given axis for supporting the opposite end of the elastic cleaning blade and for disposing the cleaning edge in resilient contact against the surface of the toner image retaining member. The cleaning edge of the elastic cleaning blade is formed by a ridge line of the protuberance which is kept in resilient contact against the surface of the toner image retaining member by the holder. The angle of intersection $\phi$ at the side of the toner image retaining member prior to contact with the cleaning blade, subtended by the axis of the holder and a tangent line at the contact point of the cleaning edge with the surface of the toner image retaining member satisfies the following relation:

$$0<\phi<\pi/2.$$

15 Claims, 4 Drawing Figures

CLEANING APPARATUS FOR ELECTROPHOTOGRAPHY

BACKGROUND OF THE INVENTION

1. Field of the Invention

The present invention relates to a cleaning apparatus using a blade for removing toner remaining on the surface of a toner image retaining member.

2. Description of the Prior Art

When an electrostatic recording apparatus in which a flat and smoothly surfaced photosensitive substance such as selenium, organic photoconductor or cadmium sulfide, or dielectric such as polycarbonate, is used, it is necessary to clean up toner remaining on the surface of the toner image retaining member such as photosensitive substance or dielectric.

For an effective cleaning method, there is known a method for the purpose by making use of an elastic blade. So far, for a blade cleaning means, there are known two types as shown in FIG. 1 and FIG. 2. In the known devices, an elastic blade 2 supported by a holding means 3 is brought into contact with a drum-shaped and clockwise rotating toner image retaining member 1 at a point of contact A. Let $\phi$ be the angle between the tangent X—X of the drum which touches the circle at point A and an axial line Y—Y of holding means 3 at the pre-cleaning side 1*a* on the surface of said drum. The known devices can be considered as there are two types, where $\phi > \pi/2$ and $\phi < \pi/2$.

(1) In the type where $\phi > \pi/2$ (Refer to FIG. 1)

In this type, as the toner image retaining member moves, the blade is bent to the cleaning side and is squeezingly deformed by a friction force between the toner image retaining member and the blade, and by the reaction force thereof the edge of the blade comes into heavy pressure contact with the toner image retaining member. Accordingly, the performance for cleaning remaining toner is great. However, as a defect thereof, there is the possibility of damaging the surface of the toner image retaining member by applying an excessive force. The afore-mentioned friction force actuates the blade to be squeezed longitudinally and a little change where the friction force makes the blade flutter.

(2) In the type of $\phi < \pi/2$ (Refer to FIG. 2)

There is no actuation of a strong reaction force from the blade caused by the friction force between the blade and the toner image retaining member, Accordingly the inconvenience caused in the type (1) does not occur in this type. On the other hand in this type, the cleaning performance is poor, so that it develops a tendency to produce defective cleaning.

Further in this type, as the angle $\phi$ is increased to approach $\pi/2$, the cleaning performance is generally improved, and there can hardly occur a toner filming phenomenon whereby toner components adhere on the surface of a toner image retaining member and a film is formed thereon. On the other hand, a bending moment is applied to the blade and the vibration of the blade is liable to occur. It thus becomes difficult to bring the blade into uniform contact with the surface of the toner image retaining member.

To stop the occurrence of the aforegoing vibration, it will do well to make the angle $\phi$ smaller. However, if the value of $\phi$ is made smaller, the cleaning performance is lowered and the toner filming phenomenon is apt to occur. Further, a foreign substance is apt to jam between the toner image retaining member and the blade, and that causes scratches on the surface of the toner image retaining member.

SUMMARY OF THE INVENTION

It is an object of the present invention to provide a stable cleaning apparatus in which the above defects are eliminated by providing a new shape of the blade.

The present invention relates to a cleaning apparatus for an electrophotographic copying machine wherein an electrostatic latent image formed on the surface of a toner image retaining member such as a photosensitive member, is moved past a series of processing stations including a developing station at which the latent image is developed with toner to form a toner image and a transfer station at which the toner image is transferred to copying material such as a copying paper, the cleaning apparatus comprising an elastic cleaning blade for removing residual toner from the surface of the toner image retaining member after transfer of the toner image to the copying material, one end of the elastic cleaning blade having a cleaning edge, and a holding means for supporting the opposite end of the elastic cleaning blade and disposing said cleaning edge in contact against the surface of the toner image retaining member, said one end of the elastic cleaning blade having a protuberance and a ridgeline of the protuberance being contact against the surface of the toner image retaining member, and an angle being defined intersection $\phi$ of, at the pre-cleaning side, subtended by the axis of the holding means contacting the toner image retaining member with said cleaning edge and a straight line touching the surface of the toner image retaining member at the contact point (at the point A in FIGS. 3 and 4), said angle $\phi$ satisfying the following relation:

$$0 < \phi < \pi/2$$

DETAILED DESCRIPTION OF THE PREFERRED EMBODIMENTS

Figure 1:
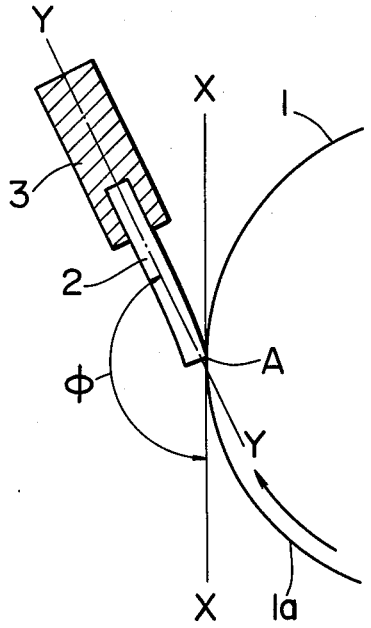
PRIOR ART FIG.1
FIG. 1 and FIG. 2 show cross-sectional views of a prior art blade-type cleaning apparatus, respectively.
Figure 2:
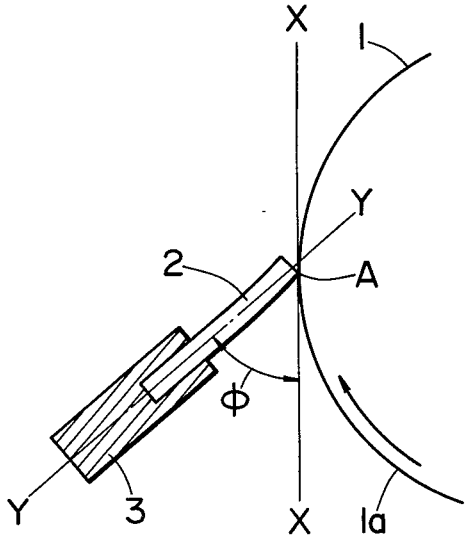
PRIOR ART FIG.2
Figure 3:
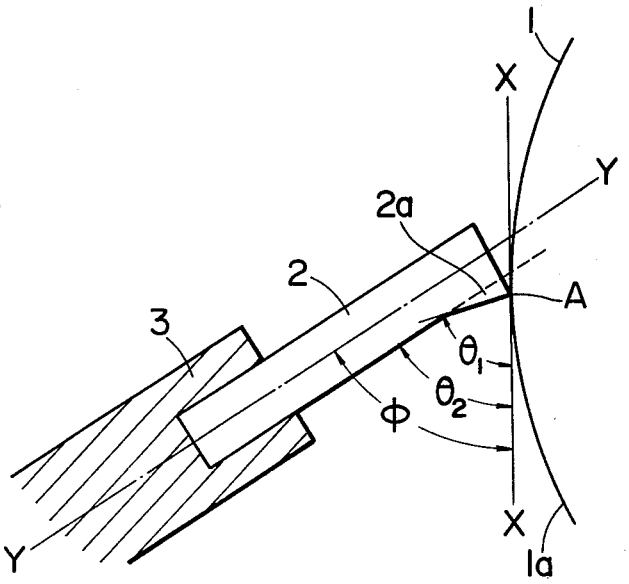
FIG. 3 and FIG. 4 show cross-sectional views illustrating respectively the embodiments of the present invention.

In FIG. 3, protuberance 2*a* of which the section is in an angular shape is provided near the end portion of the elastic blade 2 and the angle $\phi$ is arranged less than $\pi/2$. Materials of the blade are suitably synthetic rubbers which have so far been well known such as an urethane rubber, a silicone rubber, a nitril rubber, a neoprene rubber and a perflon rubber or a natural rubber. Forming thereof is made by a molding method or by a method in which a molding is made and then the edge portion where accuracy is required is polished and cut, or the like.

It is suitable that the angle $\theta_1$ of intersection of the lines of the protuberance 2*a* and the tangent to the toner image retaining member 1 at the point of contact A is $\theta_1 > \theta_2$ on the side where toner is pre-cleaned against the angle $\theta_2$ which corresponds to the case of a cleaning blade without a protuberance on the blade.

In this case, the angle $\theta_1$ is the angle that, as shown in the drawing, is made between the tangent of the toner image retaining member at the point of contact with the blade and the surface of the edge of the blade facing the pre-cleaning side of the toner image retaining member.

Actual examples are given as follows;

EXAMPLE 1

It has been known that the following conditions are comparatively preferable for an elastic blade type cleaning apparatus which has so far been utilized.

$\phi$: 60°–80° t (Thickness of the blade): 2 mm–10 mm l (Free length of the blade): 10 mm–30 mm Hardness of blade: 50°–80°

Pressing force: 10–50 gr. wt/cm

Besides the above conditions, when a blade is further designed to have a protuberance 2*a* so that the angle $\theta_1$ can be 80°–150°, the cleaning performance is more improved. Particularly, toner filming can hardly be produced, and even if the pressing force of the blade is lowered by the order of 10 gr. wt/cm relative to that of the known plate-like blade, remaining of toner on the member 1 is not observed. In this example, there is no particular limitation to the height of protuberance 2*a*, however, it is desirable that the height thereof is not less than 0.5 mm.

EXAMPLE 2

Figure 4:
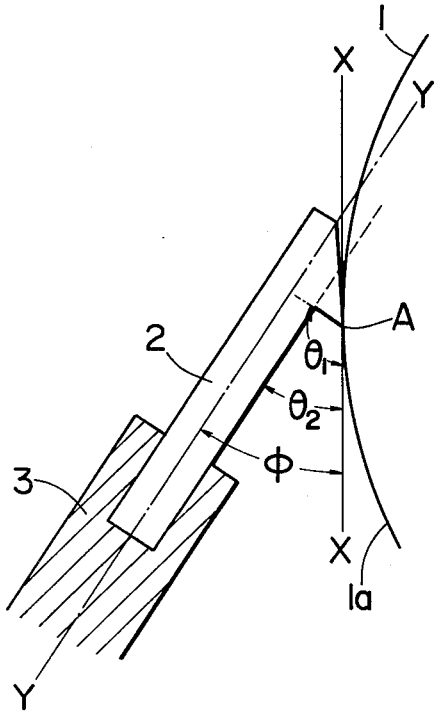

The second example is shown in FIG. 4.

$\phi$: 30°–60° t (Thickness of blade): 2 mm–10 mm l (Free length of blade): 10 mm–30 mm

Hardness of blade: 50°–80°

Pressing force: 10–50 gr. wt/cm

Even under the above mentioned condition, when protuberance 2*a'* is provided so that the angle $\theta_1$ is wide enough to be 60°–150°, a uniform pressing touch of the blade can be made without any vibration and no damage is caused by toner filming or a foreign substance on the toner image retaining member. Moveover the stable cleaning conditions can be maintained.

In the present invention, the excellent effects are observed in the following six points:

(1) No damage on the surface of the toner image retaining member is caused by friction forces.

(2) A uniform pressing touch on the surface of the toner image retaining member can be made.

(3) Stable conditions can be maintained as to vibration of the blade.

(4) No toner filming occurs on the surface of the toner image retaining member.

(5) No damage on the surface of the toner image retaining member is caused by jamming with a foreign substance such as carrier.

(6) It is easy to fix the pressing force or angle of the blade without occurrence of blade-fluttering.

What is claimed is:

1. In a cleaning apparatus for an electrophotographic copying machine wherein an electrostatic image formed on the surface of a moving toner image retaining member is moved past a series of processing stations including a developing station at which said latent image is developed with toner to form a toner image, a transfer station at which said toner image is transferred to copying material and a cleaning station for removing residual toner from the surface of said toner image retaining member, the portion of said toner image retaining member before it passes through said cleaning station comprising a pre-cleaning side thereof, said cleaning apparatus being at said cleaning station;

said cleaning apparatus comprising (i) an elongated elastic cleaning blade for removing residual toner from the surface of said toner image retaining member after transfer of said toner image to said copying material, said elastic cleaning blade having a main body portion having a longitudinal axis and two opposite ends, one end of said elastic cleaning blade having an integral free end having a cleaning edge, and (ii) a holding means arranged along a given axis for supporting the opposite end of said elastic cleaning blade and for urging said elastic cleaning blade against the surface of said toner image retaining member such that said cleaning edge is disposed in resilient contact against the surface of said toner image retaining member and such that a surface portion of the blade faces the pre-cleaning side of said toner image retaining member;

said one free end of said elastic cleaning blade having a protuberance extending therefrom, said protuberance extending outwardly from the main portion of said blade in a direction perpendicular to the axis of said blade;

said cleaning edge of said elastic cleaning blade comprising a ridgeline of said protuberance which is kept in resilient contact against the surface of said toner image retaining member by said holding means;

said elastic cleaning blade being held by said holding means such that, at the pre-cleaning side of said toner image retaining member, the angle $\theta_1$ between at least one surface portion of the edge of said blade facing said pre-cleaning side of said toner image retaining member and a tangent line at the contact point of said cleaning edge with the surface of the toner image retaining member is less than $\pi/2$; and the angle of intersection $\phi$, at the pre-cleaning side of said toner image retaining member, subtended by the axis of said holding means and a tangent line at the contact point of said cleaning edge with the surface of the toner image retaining member satisfying the following relation:

$$0<\phi<\pi/2.$$

2. In a cleaning apparatus for an electrophotographic copying machine wherein an electrostatic image formed on the surface of a moving toner image retaining member is moved past a series of processing stations including a developing station at which said latent image is developed with toner to form a toner image, a transfer station at which said toner image is transferred to copying material and a cleaning station for removing residual toner from the surface of said toner image retaining member, the portion of said toner image retaining member before it passes through said cleaning station comprising a pre-cleaning side thereof, said cleaning apparatus being at said cleaning station;

said cleaning apparatus comprising (i) an elongated elastic cleaning blade for removing residual toner from the surface of said toner image retaining member after transfer of said toner image to said copying material, said elastic cleaning blade having a longitudinal axis and two opposite ends, one end of said elastic cleaning blade having an integral free end having a cleaning edge, and (ii) a holding means arranged along a given axis for supporting the opposite end of said elastic cleaning blade and for urging said elastic cleaning blade against the surface of said toner image retaining member such that said cleaning edge is disposed in resilient contact against the surface of said toner image retaining member;

said one free end of said elastic cleaning blade having a protuberance extending therefrom;

said cleaning edge of said elastic cleaning blade comprising a ridgeline of said protuberance which is kept in resilient contact against the surface of said toner image retaining member by said holding means;

said elastic cleaning blade being held by said holding means such that, at the pre-cleaning side of said toner image retaining member, the angle $\theta_1$ between at least one surface portion of the edge of said blade facing said pre-cleaning side of said toner image retaining member and a tangent line at the contact point of said cleaning edge with the surface of the toner image retaining member is less than $\pi/2$;

the angle of intersection $\phi$, at the pre-cleaning side of said toner image retaining member, subtended by the axis of said holding means and a tangent line at the contact point of said cleaning edge with the surface of the toner image retaining member satisfying the following relation:

$$0<\phi<\pi/2; \text{ and}$$

the angle of intersection $\theta_1$, at the pre-cleaning side of said toner image retaining member subtended by said tangent line of the toner image retaining member at the contact point of said ridgeline therewith and a surface of said protuberance, and the angle of intersection $\theta_2$, at the pre-cleaning side, subtended by said tangent line and the axis of said holding means, satisfying the following relation:

$$\theta_1>\theta_2.$$

3. The cleaning apparatus of claim 2, wherein said angle of intersection $\phi$ is within a range of from 30° to 80°.

4. The cleaning apparatus of claim 3, wherein said angle of intersection $\theta_1$ is within a range of from $\alpha$° to 150°.

5. The cleaning apparatus of any one of claims 2 or 3, wherein said holding means presses said elastic cleaning blade against said toner image retaining member with a force within a range of from about 10 to 50 gr. wt/cm.

6. The cleaning apparatus of any one of claims 2 or 3, wherein said protuberance has a height relative to said elastic cleaning blade of not less than 0.5 mm.

7. The cleaning apparatus of claim 2, wherein hardness of said elastic cleaning blade is within a range of from 50° to 80°.

8. The cleaning apparatus of claim 2, wherein said toner image retaining member is a photosensitive member.

9. The cleaning apparatus of claim 2, wherein said protuberance has an angular shape.

10. The cleaning apparatus of claim 9, wherein said protuberance defines a sharp angle which is at the free end of said elastic cleaning blade which is most remote from said holding means.

11. The cleaning apparatus of claim 10, wherein said angle of intersection $\phi$ is between 60° and 80°, and said angle of intersection $\theta_1$ is between 80° and 150°.

12. The cleaning apparatus of claim 10, wherein said protuberance is generally triangular and having a surface on said pre-cleaning side which is at an obtuse angle with said longitudinal axis of said elastic cleaning blade.

13. The cleaning apparatus of claim 9, wherein said protuberance defines a sharp angle having a pointed end which is directed against the direction of movement of said toner image retaining member relative to said elastic cleaning blade, the angle of intersection $\theta_1$, at the pre-cleaning side of said toner image retaining member subtended by said tangent line of the toner image retaining member at the contact point of said ridgeline therewith and a surface of said protuberance being greater than $\pi/2$, and the angle of a surface of said protuberance relative to said last mentioned tangent line being an acute angle.

14. The cleaning apparatus of claim 13, wherein said protuberance is generally triangular and having a surface on said pre-cleaning side which is substantially perpendicular to said longitudinal axis of said elastic cleaning blade.

15. The cleaning apparatus of claim 13, wherein said angle of intersection $\phi$ is between 30° and 60°, and said angle of intersection $\theta_1$ is between 60° and 150°.

* * * * *

UNITED STATES PATENT AND TRADEMARK OFFICE

CERTIFICATE OF CORRECTION

PATENT NO. : 4,469,434

DATED : September 4, 1984

INVENTOR(S) : Yoshio YAMAZAKI et al

It is certified that error appears in the above-identified patent and that said Letters Patent is hereby corrected as shown below:

COLUMN 1, line 19, after "method" delete "for the purpose by";

COLUMN 1, line 29, change "there are" to --being of--;

COLUMN 1, line 30, change "types, where" to --types, that is where--;

COLUMN 1, line 45, after "the type" change "of" to --where--;

COLUMN 2, line 23, after "disposing" change "said" to --the--;

COLUMN 2, line 32, after "member with" change "said" to --the--;

COLUMN 2, line 58, after "is required" insert --,--;

COLUMN 5 (claim 4), lines 47-48, change "from α° to 150°" to --from 60° to 150°--.

Signed and Sealed this

*Twenty-fifth* Day of *February 1986*

[SEAL]

*Attest:*

DONALD J. QUIGG

*Attesting Officer*

*Commissioner of Patents and Trademarks*